US005518855A

United States Patent [19]

Creatura et al.

[11] Patent Number: 5,518,855

[45] Date of Patent: May 21, 1996

[54] COATED CARRIER PARTICLES AND PROCESSES THEREOF

[75] Inventors: John A. Creatura, Ontario; Catherine A. McKnight, Penfield; Michael J. Duggan, Webster; Thomas C. Dombroski, Rochester; Bernard A. Kelly, Ontario, all of N.Y.; Hadi K. Mahabadi, Toronto; Michael F. Cunningham, Georgetown, both of Canada

[73] Assignee: Xerox Corporation, Stamford, Conn.

[21] Appl. No.: 462,927

[22] Filed: Jun. 5, 1995

Related U.S. Application Data

[62] Division of Ser. No. 373,715, Jan. 17, 1995.

[51] Int. Cl.[6] ..... G03G 9/10

[52] U.S. Cl. ..... 430/137; 430/108

[58] Field of Search ..... 430/137, 109, 430/110, 108

[56] References Cited

U.S. PATENT DOCUMENTS

| | | | |
|---|---|---|---|
| 5,102,769 | 4/1992 | Creatura | 430/137 |
| 5,230,980 | 7/1993 | Maniar | 430/108 |

*Primary Examiner*—John Goodrow
*Attorney, Agent, or Firm*—E. D. Palazzo

[57] ABSTRACT

A process for preparation of conductive carrier particles which comprises mixing carrier core with a first polymer pair and a second polymer pair, heating the mixture, and cooling the mixture; and wherein the first and second polymer pair each contain an insulating polymer and a conductive polymer and wherein the carrier conductivity thereof is from about $10^{-6}$ to about $10^{-14}$ (ohm-cm)$^{-1}$.

43 Claims, No Drawings

COATED CARRIER PARTICLES AND PROCESSES THEREOF

This is a division of application Ser. No. 08/373,715, filed Jan. 17, 1995 pending.

BACKGROUND OF THE INVENTION

This invention is generally directed to carrier and developer compositions, and more specifically, the present invention relates to developer compositions with coated carrier particles prepared by a dry powder process. In embodiments of the present invention, the carrier particles are comprised of a core with coating thereover generated from a mixture of, for example, three polymers, and wherein the polymers in some embodiments are not in close proximity thereto in the triboelectric series. Moreover, in embodiments the present invention is directed to processes for the preparation of conductive carrier particles, that is with a conductivity of from about $10^{-15}$ to about $10^{-6}$ $(\text{ohm-cm})^{-1}$, and which carriers possess stable triboelectrical characteristics in the range of from about a negative to a positive 40, 10 to about 35, and preferably in the range of from about 20 to about 25 microcoulombs per gram. Developer compositions comprised of the carrier particles of the present invention are useful in electrostatographic or electrophotographic imaging and printing systems, especially xerographic imaging processes. Additionally, the carrier particles of the present invention are useful in imaging methods wherein relatively constant conductivity parameters are desired. Furthermore, in the aforementioned imaging processes the triboelectric charge on the carrier particles can be preselected depending on the polymer composition applied to the carrier core.

Advantages associated with the present invention include the enablement of obtaining a range of preselected conductivities for carrier particles; permitting the preselection of the triboelectric charge desired on the carrier particles; independently varying and preselecting both conductivity and triboelectric charge; fully and completely coated cores can be obtained wherein the conductive characteristics are not primarily dependent on, or provided by the amount of coating; and long developer life exceeding, for example, 1,000,000 xerographic imaging cycles and wherein the carrier conductivity is from about $10^{-15}$ to about $10^{-6}$ $(\text{ohm-cm})^{-1}$.

Numerous different types of xerographic imaging processes are known wherein, for example, insulative developer particles or certain conductive carrier components are selected depending on the development systems used. Moreover, of importance with respect to the aforementioned developer compositions is the appropriate conductivity and triboelectric charging values associated therewith, as it is these values that are of importance for the enablement of continued constant developed images of high quality and excellent resolution.

Carrier particles for use in the development of electrostatic latent images are described in many patents including, for example, U.S. Pat. No. 3,590,000. These carrier particles may comprise various cores, including steel, with a coating thereover of fluoropolymers, and terpolymers of styrene, methacrylate, and silane compounds. A number of carrier coatings, especially carriers which have not been fully coated, can deteriorate rapidly, especially when selected for a continuous xerographic process where the entire coating may separate from the carrier core in the form of chips or flakes, and fail upon impact, or abrasive contact with machine parts and other carrier particles. These flakes or chips, which cannot generally be reclaimed from the developer mixture, have an adverse effect on the triboelectric charging characteristics of the carrier particles, thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity. The aforementioned modification in triboelectric charging characteristics provides developed images of lower quality, and with background deposits.

There are also illustrated in U.S. Pat. No. 4,233,387, the disclosure of which is totally incorporated herein by reference, coated carrier components for electrostatographic developer mixtures comprised of finely divided toner particles clinging to the surface of the carrier particles. Specifically, there is disclosed in this patent coated carrier particles obtained by mixing carrier core particles of an average diameter of from between about 30 microns to about 1,000 microns, with from about 0.05 percent to about 3.0 percent by weight, based on the weight of the coated carrier particles, of thermoplastic resin particles. The resulting mixture is then dry blended until the thermoplastic resin particles adhere to the carrier core by mechanical impaction, and/or electrostatic attraction. Thereafter, the mixture is heated to a temperature of from about 320° F. to about 650° F. for a period of about 20 minutes to about 120 minutes enabling the thermoplastic resin particles to melt and fuse on the carrier core. While the developer and carrier particles prepared in accordance with the process of this patent are suitable for their intended purposes, the conductivity values of the resulting particles are not constant in all instances; for example, when a change in carrier coating weight is accomplished to achieve a modification of the triboelectric charging characteristics, and further with regard to the '387 patent, in many situations carrier and developer mixtures with only specific triboelectric charging values can be generated when certain conductivity values or characteristics are contemplated. With the invention of the present application, the conductivity of the resulting carrier particles can be preselected, and moreover, the triboelectric values can be selected to vary significantly, for example from less than −15 microcoulombs per gram to greater than 70 microcoulombs per gram, depending on the polymer mixture selected for affecting the coating processes.

Carrier particles with polymer coatings thereover and which polymers are not in close proximity in the triboelectric series are known, reference U.S. Pat. Nos. 4,937,166 and 4,935,326, the disclosures of which are totally incorporated herein by reference. There are illustrated in these patents carrier particles comprised of a core with a coating thereover comprised of a mixture of a first dry polymer component and a second dry polymer component, which polymer components are not in close proximity in the triboelectric series. These carrier particles can be comprised of known core materials including iron with a dry polymer coating mixture thereover. Subsequently, developer compositions can be generated by admixing the aforementioned carrier particles with a toner composition comprised of resin particles and pigment particles. The percentage of each polymer present in the carrier coating mixture can vary depending on the specific components selected, the coating weight and the properties desired. Generally, the coated polymer mixtures used contain from about 10 to about 90 percent of the first polymer, and from about 90 to about 10 percent by weight of the second polymer. Preferably, there are selected mixtures of polymers with from about 40 to about 60 percent by weight of the first polymer, and from about 60 to about 40 percent by weight of a second polymer. When a high triboelectric charging value is desired, that is exceeding −50 microcoulombs per gram, there is selected from about 90 percent by weight of the first polymer, such as polyvinylidene fluoride; and 10 percent by weight of the second polymer, such as polyethylene. In contrast, when a lower triboelectric charging value is desired, less than about 20 microcoulombs per gram, there is selected from about 10 percent by weight of the first polymer, and 90 percent by weight of the second polymer. Also, there are disclosed in these patents carrier particles of relatively constant conductivities of from between about $10^{-15}$ (ohm-cm)$^{-1}$ to from about $10^{-9}$ (ohm-cm)$^{-1}$ at, for example, a 10 volt impact across a 0.1 inch gap containing carrier beads held in place by a magnet; and wherein the carrier particles are of a triboelectric charging value of from −15 microcoulombs per gram to −70 microcoulombs per gram, these parameters being dependent on the coatings selected, and the percentage of each of the polymers used. With the carriers of the present invention, which are preferably essentially completely coated, that is 100 percent coating, the conductivity is provided by the coating polymer, for example four polymers, two polymer pairs, three polymers, and the like, and a number of different conductivities can be achieved in the range of, for example, $10^{-6}$ to about $10^{-15}$ (ohm-cm)$^{-1}$; and further, with the invention carriers there is achievable in embodiments longer lifetimes, superior wear resistance, and excellent resistance to humidity as compared to the carriers of the aforementioned patents.

With further reference to the prior art, carriers obtained by applying insulating resinous coatings to porous metallic carrier cores using solution coating techniques are undesirable from many viewpoints. For example, the coating material will usually reside in the pores of the carrier cores, rather than at the surfaces thereof; and, therefore, is not available for triboelectric charging when the coated carrier particles are mixed with finely divided toner particles. Attempts to resolve this problem by increasing the carrier coating weights, for example, to as much as 3 percent or greater to provide an effective triboelectric coating to the carrier particles necessarily involves handling excessive quantities of solvents, and further usually these processes result in low product yields. Also, solution coated carrier particles when combined and mixed with finely divided toner particles provide in some instances triboelectric charging values which are too low for many uses. The processes, especially powder coating processes of the present invention, overcome or minimize these disadvantages, and further enables developer mixtures that are capable of generating high and useful triboelectric charging values with finely divided toner particles; and also wherein the carrier particles are of a preselected constant conductivity. Moreover, when resin coated carrier particles are prepared by the powder coating process of the present invention, the majority of the coating materials are fused to the carrier surface thereby reducing the number of toner impaction sites on the carrier material. Additionally, there can be achieved with the process of the present invention, independent of one another, desirable triboelectric charging characteristics and conductivity values; that is, for example the triboelectric charging parameter is not dependent on the carrier coating weight as is believed to be the situation with the process of U.S. Pat. No. 4,233,387 wherein an increase in coating weight on the carrier particles may function to also permit an increase in the triboelectric charging characteristics. Specifically, therefore, with the carrier compositions and process of the present invention there can be formulated developers with selected triboelectric charging characteristics and/or conductivity values in a number of different combinations.

Thus, for example, there can be formulated in accordance with the invention of the present application developers with conductivities of from about $10^{-15}$ (ohm-cm)$^{-1}$ to about $10^{-6}$ (ohm-cm)$^{-1}$ as determined in a magnetic brush conducting cell; and triboelectric charging values of from about a −40 to a positive 40 microcoulombs per gram; and in embodiments a positive 10 to a positive 30 on the carrier particles as determined by the known Faraday cage technique. Thus, the developers of the present invention can be formulated with constant conductivity values with different triboelectric charging characteristics by, for example, selecting certain carrier coating mixtures.

Other patents of interest include U.S. Pat. No. 3,939,086, which teaches steel carrier beads with polyethylene coatings, see column 6; U.S. Pat. No. 4,264,697, which discloses dry coating and fusing processes; U.S. Pat. Nos. 3,533,835; 3,658,500; 3,798,167; 3,918,968; 3,922,382; 4,238,558; 4,310,611; 4,397,935 and 4,434,220.

SUMMARY OF THE INVENTION

Examples of objects of the present invention include:

It is an object of the present invention to provide toner and developer compositions with carrier particles containing polymer mixture coatings.

In another object of the present invention there are provided dry coating processes for generating carrier particles with substantially constant conductivity parameters.

In yet another object of the present invention there are provided dry coating processes for generating carrier particles of substantially constant conductivity parameters, and a wide range of preselected triboelectric charging values.

In yet another object of the present invention there are provided carrier particles with varying triboelectric values and preselected conductivities, or varying conductivities, including semiconductive, and preselected triboelectric values.

In yet a further object of the present invention there are provided processes for the preparation of conductive carrier particles comprised of a coating with a first polymer pair and a second polymer pair mixture of polymers.

In still a further object of the present invention there are provided carrier particles with a mixture of four polymers coated thereover and wherein one polymer is conductive and one polymer is insulating.

Further, in an additional object of the present invention there are provided carrier particles comprised of a core with a coating thereover generated from a mixture of two polymer pairs, and wherein the triboelectric charging values are from about −40 microcoulombs to about +40 microcoulombs per gram at the same coating weight.

In another object of the present invention there are provided methods for the development of electrostatic latent images wherein the developer mixture comprises carrier particles with a coating thereover consisting of a mixture of two pairs of polymers.

Also, in another object of the present invention there are provided positively charged toner compositions, or negatively charged toner compositions having incorporated therein carrier particles with a coating thereover comprised of a mixture of four polymers or two polymer pairs, and wherein for each polymer pair a conductive polymer is selected.

Moreover, in another object of the present invention there are provided processes, including economical continuous processes, for the preparation of semiconductive carriers by the addition to carrier cores of a mixture of two polymers, or a conductive polymer, for example polymethylmethacrylate containing a conductive component like carbon black, and a mixture of two polymers, like KYNAR® and polymethylmethacrylate, thereby permitting the control and design of tribo and conductivity across a wide range.

Additionally, in another object of the present invention there are provided processes for the preparation of carrier particles wherein the tribo charge and conductivity thereof can be independently controlled.

Another object of the present invention resides in the provision of carrier processes wherein two polymer insulative and two polymer conductive carriers are merged, and wherein the ratios of each of the aforementioned polymer pairs can be varied to enable a specific conductivity, and wherein the carrier tribo can be varied based on the high and low polymer components; more specifically, for example, to target carrier tribo the ratio of conductive and insulative coatings like KYNAR® to the conductive and insulating coatings of, for example, polymethylmethacrylate is varied; and to target conductivity the ratio of conductive polymer like KYNAR® and conductive polymethylmethacrylate to insulating polymer like KYNAR® and insulating polymethylmethacrylate (PMMA) can be varied. To obtain conductive polymers, usually a conductive component like carbon black is dispersed in the polymer coating selected. Three polymer mixtures may also be selected for the present invention, such as conductive PMMA, insulative PMMA, and insulative KYNAR®.

These and other objects of the present invention are accomplished by providing developer compositions comprised of toner particles, and conductive carrier particles prepared by a powder coating process; and wherein the carrier particles are comprised of a core with a coating thereover, which coating is comprised of more than two polymers and preferably four polymers. More specifically, the carrier particles selected can be prepared by mixing carrier core, or a carrier core like a low density porous magnetic, or magnetically attractable metal core carrier particles with from, for example, between about 0.05 percent and about 3 percent by weight, based on the weight of the coated carrier particles, with a mixture of three, or four polymers until adherence thereof to the carrier core by mechanical impaction and/or electrostatic attraction; heating the mixture of carrier core particles and polymers to a temperature, for example, of between from about 200° F. to about 650° F. and in embodiments 320° F. to 650° F.; for a period of time as indicated herein and in embodiments from about 10 minutes to about 60 minutes enabling the polymers to melt and fuse to the carrier core particles; cooling the coated carrier particles; and thereafter classifying the obtained carrier particles to a desired particle size. Examples of two polymer pairs include a first polymer pair of a conductive polymer and an insulating polymer and a second polymer pair of a conductive polymer and an insulating polymer, and wherein the polymer pairs are triboelectrically dissimilar. In embodiments, the present invention is directed to processes for the preparation of conductive carrier particles, which comprises mixing carrier core with a first polymer pair and a second polymer pair, heating the mixture, and cooling the mixture; and wherein the first and second polymer pair each contain an insulating polymer and a conductive polymer, and wherein the carrier conductivity thereof is from about $10^{-6}$ to about $10^{-14}$ (ohm-cm)$^{-1}$; a process for the preparation of carrier particles with substantially stable conductivity parameters which comprises (1) mixing carrier cores with a first polymer pair and a second polymer pair, and wherein the first and second polymer pair contains an insulating polymer and a conductive polymer; (2) dry mixing the carrier core particles and the polymer mixtures for a sufficient period of time enabling the polymer mixture to adhere to the carrier core particles; (3) heating the mixture of carrier core particles and polymer mixture to a temperature of between about 200° F. and about 550° F., whereby the polymer mixture melts and fuses to the carrier core particles; and (4) thereafter cooling the resulting coated carrier particles; a process for the preparation of conductive carrier particles which comprises mixing a carrier core with a first polymer and a second polymer pair, heating the mixture, and cooling the mixture; and wherein the first polymer is insulating and the second polymer pair contains an insulating polymer and a conductive polymer, and wherein the carrier conductivity thereof is from about $10^{-6}$ to about $10^{-14}$ (ohm-cm)$^{-1}$; a process for the preparation of carrier particles which comprises mixing carrier cores with a first polymer pair and a second polymer pair, heating the mixture, and cooling the mixture; and wherein the first and second polymer pair each contain an insulating polymer and a conductive polymer; and a carrier composition comprised of a core with coatings comprised of a first polymer pair, or a first polymer, and a second polymer pair; and wherein the first and second polymer pair each contain an insulating polymer and a conductive polymer.

In embodiments of the present invention there are provided carrier particles comprised of a core with a coating thereover comprised of a mixture of a first dry polymer pair component and a second dry polymer pair component, and wherein the first pair is comprised of a conductive polymer like polymethylmethacrylate having dispersed therein a conductive component like carbon black and an insulating polymer like polymethylmethacrylate, and the second pair contains a conductive polymer like polyvinylidine fluoride with a conductive component like carbon black dispersed therein and an insulating polymer.

Examples of polymers selected for the first polymer pair include a first polymer pair of polymethylmethacrylate and polymethylmethacrylate with a conductive component like carbon black dispersed therein, or polystyrene and polystyrene with a conductive component like carbon black, and a second pair of polytrifluoroethyl methacrylate, or polyvinylidene fluoride, and polytrifluoroethyl methacrylate, or polyvinylidene fluoride with a conductive component dispersed therein, such as carbon black, and the like. Generally the polymer pairs each contain an insulating polymer like PMMA and a conductive polymer like PMMA with carbon black. Thus, for the two polymer pairs there can be selected PMMA, conductive PMMA, KYNAR® and conductive KYNAR®. In embodiments, there can be selected three polymers comprised of a first insulating polymer like KYNAR®, in an amount, for example, of about 20 weight percent, and a polymer pair like insulating PMMA, 70 weight percent, and about 10 weight percent of conductive PMMA, that is PMMA with a conductive component dispersed therein. Examples of polymers include those as illustrated in the patents mentioned herein such as U.S. Pat. Nos. 4,937,166 and 4,935,326 providing there are two polymer pairs, or three polymers present as indicated herein. The amount of polymer selected for the polymer pairs, or for the three polymer system can vary depending, for example, on the carrier characteristics desired. For example, the first polymer pair can contain an insulating polymer in an amount of from about 35 to about 70 weight percent and a conductive polymer in an amount of from about 35 to 70 weight percent; and the second polymer pair can contain an insulating polymer in an amount of from about 35 to about 70 weight percent and a conductive polymer in an amount of from about 35 to 70 weight percent. Moreover, examples of amounts of each polymer are as illustrated herein, such as the diagrams that follow. The first polymer pair is present, for example, in an amount of from about 1 to about 99 weight percent, and the second polymer pair is present in an amount of from about 1 to about 99 weight percent. Examples of conductive components that can be included in the polymer coating mixtures, include carbon blacks, metals, metal oxide powders, especially tin oxide, fluorinated carbon blacks, powdered magnetites, and the like in various effective amounts such as from about 1 to about 50, 1 to about 30, and preferably from about 10 to about 20 weight percent.

With further reference to the polymer coating mixture, by close proximity as used herein it is meant, for example, that the choice of the polymers selected are dictated by their position in the triboelectric series, therefore, for example, in embodiments, one may select a first polymer pair with a significantly lower triboelectric charging value than the second polymer pair. More specifically, not in close proximity refers to first and second polymer pairs that are at different electronic work function values, that is they are not at the same electronic work function value. Additionally, the difference in electronic work functions between the first and second polymer pairs is at least 0.2 electron volt, and preferably is about 2 electron volts; and moreover, it is known that the triboelectric series corresponds to the known electronic work function series for polymers, reference Electrical Properties of Polymers, Seanor, D. A., Chapter 17, Polymer Science, A. D. Jenkins, Editor, North Holland Publishing (1972), the disclosure of which is totally incorporated herein by reference.

The percentage of each polymer present in the carrier coating mixture can vary depending on the specific components selected, the coating weight and the properties desired. Generally, the coated polymer mixtures used contain from about 10 to about 90 percent of the first polymer pair, and from about 90 to about 10 percent by weight of the second polymer pair. Preferably, there are selected mixtures of polymers with from about 20 to about 40 percent by weight of the first polymer pair, and from about 80 to about 60 percent by weight of the second polymer pair.

Subsequently, developer compositions of the present invention can be generated by admixing the aforementioned carrier particles with a toner composition comprised of resin particles and pigment particles.

Various suitable solid core carrier materials, or mixtures thereof can be selected for the present invention. Characteristic core properties of importance include those that will enable the toner particles to acquire a positive charge or a negative charge, and carrier cores that will permit desirable flow properties in the developer reservoir present in the xerographic imaging apparatus. Also of value with regard to the carrier core properties are, for example, suitable magnetic characteristics that will permit magnetic brush formation in magnetic brush development processes; and also wherein the carrier cores possess desirable mechanical aging characteristics. Examples of carrier cores that can be selected include iron, steel, ferrites like copper, zinc, and manganese and the like, available from Steward Chemicals, magnetites, nickel, and mixtures thereof. Preferred carrier cores include ferrites, and sponge iron, or steel grit with an average particle size diameter of from between about 30 microns to about 200 microns.

Also, there results, in accordance with embodiments of the present invention, carrier particles of relatively constant conductivities of from between about $10^{-15}$ (ohm-cm)$^{-1}$ to from about $10^{-6}$ (ohm-cm)$^{-}$at, for example, a 10 volt impact across a 0.1 inch gap containing carrier beads held in place by a magnet; and wherein the carrier particles are of a triboelectric charging value of from –40 microcoulombs per gram to a positive +40 microcoulombs per gram, these parameters being dependent on the coatings selected, and the percentage of each of the polymers used as indicated hereinbefore.

Various effective suitable means can be used to apply the polymer mixture pair coatings to the surface of the carrier particles. Examples of typical means for this purpose include combining the carrier core material, and the pair mixture of polymers by cascade roll mixing, or tumbling, milling, shaking, electrostatic powder cloud spraying, fluidized bed, electrostatic disc processing, and an electrostatic curtain. Following application of the polymer mixture, heating is initiated to permit flowout of the coating material over the surface of the carrier core. The concentration of the coating material powder particles, as well as the parameters of the heating step, may be selected to enable the formation of a continuous film of the coating material on the surface of the carrier core, or permit only selected areas of the carrier core to be coated. When selected areas of the metal carrier core remain uncoated or exposed, the carrier particles will possess electrically conductive properties when the core material comprises a metal. The aforementioned conductivities can include various suitable values. Generally, however, this conductivity is from about $10^{-17}$ to about $10^{-6}$ (ohm-cm)$^{-1}$, and more specifically, for the three polymer mixture from about $10^{-15}$ to about $10^{-6}$, as measured, for example, across a 0.1 inch magnetic brush at an applied potential of 10 volts; and wherein the coating coverage encompasses from about 10 percent to about 100 percent of the carrier core.

Illustrative examples of finely divided toner resins selected for the developer compositions of the present invention include polyamides, epoxies, polyurethanes, diolefins, vinyl resins, styrene acrylates, styrene methacrylates, styrene butadienes, polyesters such as the polymeric esterification products of a dicarboxylic acid and a diol comprising a diphenol, crosslinked polyesters, and the like. Specific vinyl monomers include styrene, p-chlorostyrene vinyl naphthalene, unsaturated monoolefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride and vinylidene chlorofluoride; N-vinyl indole, N-vinyl pyrrolidene; and the like. Also, there may be selected styrene butadiene copolymers, mixtures thereof, and the like.

As one toner resin there can be selected the esterification products of a dicarboxylic acid and a diol comprising a diphenol, reference U.S. Pat. No. 3,590,000, the disclosure of which is totally incorporated herein by reference. Other preferred toner resins include styrene/methacrylate copolymers; styrene/butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol, and reactive extruded polyesters. Generally, from about 1 part to about 5 parts by weight of toner particles are mixed with from about 10 to about 300 parts by weight of the carrier particles of the present invention.

Numerous well known suitable pigments or dyes can be selected as the colorant for the toner particles including, for example, carbon black like REGAL 330®, nigrosine dye, lamp black, iron oxides, magnetites, colored magnetitites other than black, and mixtures thereof. The pigment, which is preferably carbon black, should be present in a sufficient amount to render the toner composition highly colored. Thus, the pigment particles can be present in amounts of from about 3 percent by weight to about 20 and preferably from 5 to about 15 percent by weight, based on the total weight of the toner composition, however, lesser or greater amounts of pigment particles may be selected in embodiments.

When the pigment particles are comprised of magnetites, which are a mixture of iron oxides ($FeO.Fe_2O_3$) including those commercially available as MAPICO BLACK™, they are present in the toner composition in an amount of from about 10 percent by weight to about 70 percent by weight, and preferably in an amount of from about 20 percent by weight to about 50 percent by weight.

The resin particles are present in a sufficient, but effective amount, thus when 10 percent by weight of pigment, or colorant such as carbon black is contained therein, about 90 percent by weight of resin material is selected. Generally, however, the toner composition is comprised of from about 85 percent to about 97 percent by weight of toner resin particles, and from about 3 percent by weight to about 15 percent by weight of pigment particles such as carbon black.

Also encompassed within the scope of the present invention are colored toner and developer compositions comprised of toner resin particles, carrier particles, and as pigments or colorants, red, green, brown, blue, magenta, cyan and/or yellow particles, as well as mixtures thereof. More specifically, illustrative examples of magenta materials that may be selected as pigments include 1,9-dimethyl-substituted quinacridone and anthraquinone dye identified in the color index as CI 60720, CI Dispersed Red 15, a diazo dye identified in the color index as CI 26050, CI Solvent Red 19, and the like. Examples of cyan materials that may be used as pigments include copper tetra-4(octaecyl sulfonamido) phthalocyanine, X-copper phthalocyanine pigment listed in the color index as CI 74160, CI Pigment Blue, and Anthrathrene Blue, identified in the color index as CI 69810, Special Blue X-2137, and the like; while illustrative examples of yellow pigments that may be selected are diarylide yellow 3,3-dichlorobenzidene acetoacetanilides, a monoazo pigment identified in the color index as CI 12700, CI Solvent Yellow 16, a nitrophenyl amine sulfonamide identified in the color index as Foron Yellow SE/GLN, CI Dispersed Yellow 33, 2,5-dimethoxy- 4-suifonanilide phenylazo-4'-chloro-2,5-dimethoxy acetoacetanilide, permanent yellow FGL, and the like. These pigments are generally present in the toner composition in an amount of from about 1 weight percent to about 15 weight percent based on the weight of the toner resin particles.

For further enhancing the positive charging characteristics of the developer compositions described herein, and as optional components there can be incorporated into the toner or on its surface charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; bisulfate, and the like and other similar known charge enhancing additives. Also, negative charge enhancing additives may also be selected, such as aluminum complexes, like BONTRON E-88®, and the like. These additives are usually incorporated into the toner in an amount of from about 0.1 percent by weight to about 20 percent by weight, and preferably from 1 to about 3 percent by weight.

The toner composition of the present invention can be prepared by a number of known methods including melt blending the toner resin particles, and pigment particles or colorants followed by mechanical attrition. Other methods include those well known in the art such as spray drying, melt dispersion, dispersion polymerization, suspension polymerization, and extrusion. In one dispersion polymerization method, a solvent dispersion of the resin particles and the pigment particles is spray dried under controlled conditions to result in the desired product. Generally, the toners are prepared by mixing, followed by attrition, and classification to enable toner particles with an average volume diameter of from about 5 to about 20 microns.

Also, the toner and developer compositions of the present invention may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Examples of generating layers are trigonal selenium, metal phthalocyanines, metal free phthalocyanines and vanadyl phthalocyanines. As charge transport molecules there can be selected the aryl diamines disclosed in the '990 patent. Also, there can be selected as photogenerating pigments squaraine compounds, thiapyrillium materials, and the like. These layered members are conventionally charged negatively thus requiring a positively charged toner. Moreover, the developer compositions of the present invention are particularly useful in electrostatographic imaging processes and apparatuses wherein there are selected a moving transporting means and a moving charging means; and wherein there is selected a deflected flexible layered imaging member, reference U.S. Pat. Nos. 4,394,429 and 4,368,970, the disclosures of which are totally incorporated herein by reference.

Images obtained with the developers composition of the present invention exhibited in embodiments acceptable solids, excellent halftones and desirable line resolution with acceptable or substantially no background deposits.

Also, there can be obtained in accordance with the process of the present invention carrier particles with positive triboelectric charging values thereon of from about 10 to about 80 microcoulombs per gram by, for example, selecting as carrier coatings polyethylene, and polymethyl methacrylates.

The processes and compositions of the present invention are further illustrated with reference to the following diagrams wherein PMMA is polymethylmethacrylate; CB is carbon black; $PVF_2$ is KYNAR®, a polyvinylidene fluoride; the Log Conductivity is for the carrier; and wherein the carrier core is iron; the tribo is for the carrier and wherein the carrier core was iron; and wherein, for example, the −13.6 on the Log diagram represents 20 percent of carbon black loaded PMMA, 40 percent of $PVF_2$ (KYNAR®) and 40 percent of PMMA.

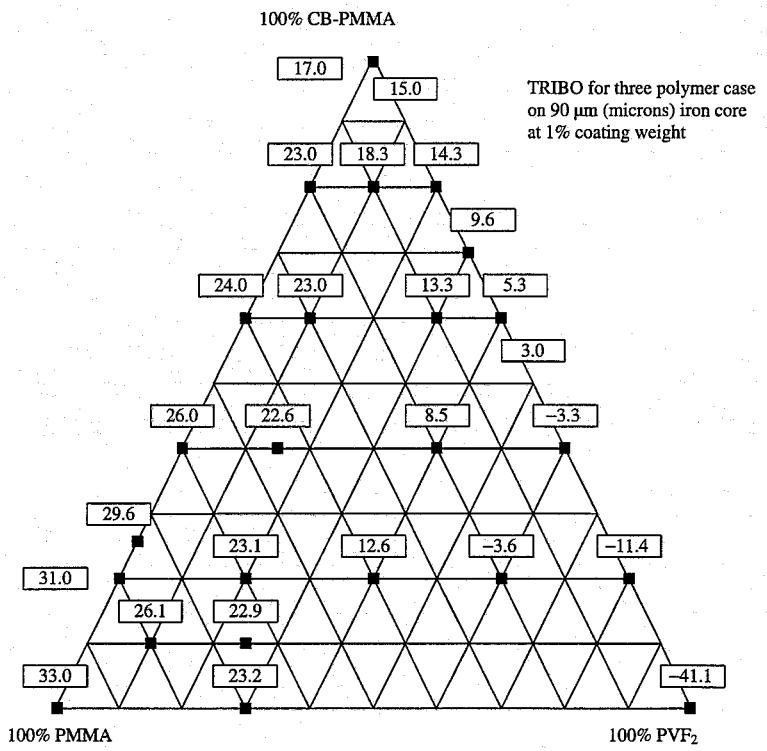

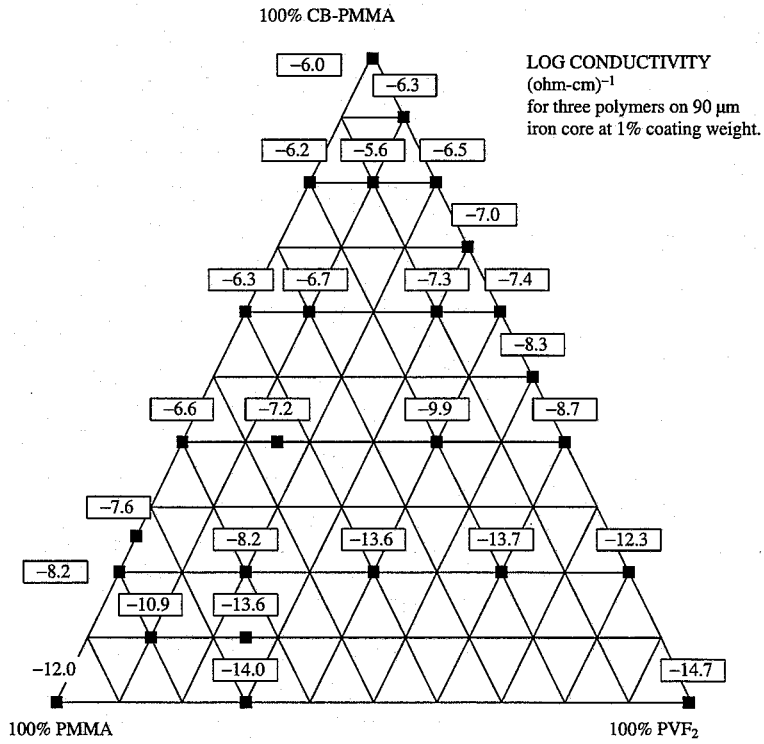

The following Examples are being supplied to further define the present invention, it being noted that these Examples are intended to illustrate and not limit the scope of the present invention. Parts and percentages are by weight unless otherwise indicated. Comparative data is also presented.

COMPARATIVE EXAMPLE I

There were prepared carrier particles by coating 2,268 grams of a Hoeganaes atomized steel core, 90 micron weight median diameter, with 22.7 grams (1 percent coating weight) of a polymer mixture comprised of 6.81 grams (30 percent) of a polyvinylidene fluoride, available as KYNAR® 301F, and 15.89 grams (70 percent) of polymethylmethacrylate, available from Soken Chemicals. These components were combined in a twin cone mixer for 20 minutes at 23.5 rpm, resulting in the polymer being uniformly distributed and mechanically and/or electrostatically attached to the carrier core. Thereafter, the resulting carrier particles were placed into a rotating tube furnace. The furnace was maintained at 400° F., thereby causing the polymer to melt and fuse to the core.

A developer mixture was then prepared by mixing 200 grams of the above prepared carrier with 6 grams of a toner comprised of 89 weight percent of the extruded crosslinked polyester of U.S. Pat. No. 5,227,460, the disclosure of which is totally incorporated herein by reference, REGAL 330® carbon black, 5 weight percent, 6 weight percent of the low molecular weight wax 660P available from Sanyo Chemicals of Japan, and as a surface additive fumed silica, TS530 AEROSIL®, available from Degussa Chemicals, 1 weight percent.

Thereafter, the triboelectric charge on the carrier was determined by the known Faraday Cage process, and there were measured on the carrier 23.2 microcoulombs per gram. Further, the conductivity of the carrier as determined by forming a 0.1 inch long magnetic brush of the carrier particles, and measuring the conductivity by imposing a 10 volt potential across the brush was $1\times10^{-14}$ (ohm-cm)$^{-1}$. Therefore, these carrier particles are insulating.

In all the Examples, the triboelectric charging values and the conductivity numbers were obtained in accordance with the aforementioned procedures.

EXAMPLE II

The process of Example I was repeated with a carrier coating of 65 weight percent of polymethylmethacrylate, 25 weight percent of KYNAR®, and 10 weight percent of polymethylmethacrylate with 20 percent of carbon black. The carrier tribo charge was 23.9 microcoulombs per gram, and the carrier conductivity was $3\times10^{-14}$ (ohm-cm)$^{-1}$.

EXAMPLE III

A developer of the present invention was prepared by repeating the processes of Example II with the exception that 4.54 grams (20 percent) of conductive polymethylmethacrylate were introduced to the polymer mixture. The polyvinylidene fluoride and polymethylmethacrylate amounts were each reduced by 10 percent providing a polymer mixture comprised of 4.54 (20 percent) grams of polyvinylidene fluoride, 13.62 grams (60 percent) of polymethylmethacrylate, and 4.54 grams (20 percent) of carbon black loaded conductive polymethylmethacrylate. The resulting carrier particles had a measured triboelectric charge thereon of 23.1 microcoulombs per gram. Also, the carrier particles had a conductivity of $6\times10^{-9}$ mho-cm$^{-1}$, which is considered semiconductive. Therefore, by retaining the amounts of polyvinylidene fluoride and polymethylmethacrylate relatively constant and introducing 20 weight percent of carbon black loaded conductive polymethylmethacrylate, the carrier particles changed from insulative to semiconductive without affecting the triboelectric charging of the carrier particles.

EXAMPLE IV

The process of Example III was repeated with 45 weight percent of polymethylmethacrylate, 15 weight percent of KYNAR®, and 40 weight percent of carbon black loaded polymethylmethacrylate, and the conductivity of the carrier was $6\times10^{-8}$ (ohm-cm)$^{-1}$ and the tribo was 22.6 (microcoulombs per gram throughout).

EXAMPLE V

A developer composition of the present invention was prepared by repeating the process of Example I and further increasing the weight percent of carbon black loaded polymethylmethacrylate in the polymer mixture. The polymer mixture was comprised of 2.27 grams (10 percent) of polyvinylidene fluoride, 6.81 grams (30 percent) of polymethylmethacrylate, and 13.62 grams (60 percent) of carbon black loaded polymethylmethacrylate. There resulted on the carrier particles a triboelectric charge of 23.0 microcoulombs per gram, and the carrier particles had a conductivity of $2\times10^{7}$(ohm-cm)$^{-1}$. The triboelectric charging properties of the carrier were similar to those of Example I, however, the conductivity has increased further to create a fully conductive carrier. A carrier can be considered fully conductive if the measured conductivity is of the same order of magnitude of the uncoated carrier core.

EXAMPLE VI

A developer composition of the present invention was prepared by repeating the process of Example I with the exception that the polymer mixture was comprised of 6.81 grams (30 percent) of polyvinylidene fluoride, 2.27 grams (10 percent) of polymethylmethacrylate, and 13.62 grams (60 percent) of carbon black loaded polymethylmethacrylate. There resulted on the carrier particles a triboelectric charge of 13.3 microcoulombs per gram, and the carrier particles had a conductivity of $1\times 10^{-6}$ mho-cm$^{-1}$. Thus, compared to Example II, this carrier is also semiconductive, however, the triboelectric charging properties have been altered to produce carrier particles with less triboelectric charging potential.

A carrier with a conductivity and a lower tribo than that of Example II can be formulated with 30 percent of polyvinylidene fluoride, 20 percent of polymethylmethacrylate and 50 percent of carbon black loaded conductive polymethylmethacrylate.

EXAMPLE VII

The process of Example III was repeated except that the carrier coating mixture was comprised of four polymers of 30 weight percent of PMMA, 60 weight percent of carbon black loaded conductive PMMA with 10 weight percent of carbon black dispersed therein, 5 weight percent of polytrifluoroethylmethacrylate, and 5 weight percent of conductive polytrifluoroethylmethacrylate with 10 weight percent of carbon black dispersed therein, and the carrier tribo was 23 and the carrier conductivity was $1\times10^{-9}$ mho-cm$^{-1}$.

EXAMPLE VIII

The process of Example III was repeated except that the carrier coating mixture was comprised of four polymers of 45 weight percent of PMMA, 40 weight percent of carbon black loaded PMMA with 10 weight percent of carbon black dispersed therein, 10 weight percent of polytrifluoroethylmethacrylate, and 5 weight percent of conductive polytrifluoroethylmethacrylate with 10 weight percent of carbon black dispersed therein, and the carrier tribo was 23 and the carrier conductivity was $3\times10^{-11}$ mho-cm$^{-1}$.

Other modifications of the present invention may occur to those skilled in the art based upon a reading of the present disclosure, and these modifications are intended to be included within the scope of the present invention.

What is claimed is:

1. A dry process for the preparation of conductive carrier particles consisting essentially of mixing carrier core with a first polymer pair and a second polymer pair, heating the mixture, and cooling the mixture; and wherein the first and second polymer pair each contain an insulating polymer and a conductive polymer and wherein the carrier conductivity thereof is from about $10^{-6}$ to about $10^{-14}$ (ohm-cm)$^{-1}$, and wherein said first polymer pair and said second polymer pair are triboelectrically dissimilar.

2. A dry process in accordance with claim 1 wherein the first polymer pair is comprised of an insulating polymer and a conductive polymer, and the second polymer pair is comprised of an insulating polymer and a conductive polymer; and wherein the conductive polymer contains dispersed therein a conductive component.

3. A process in accordance with claim 2 wherein the conductive component is carbon black present in an amount of from about 10 to about 50 weight percent.

4. A process in accordance with claim 2 wherein the first polymer pair is comprised of an insulating polymethylmethacrylate and a conductive polymethylmethacrylate, and the second polymer pair is comprised of an insulating polyvinylidene fluoride and a conductive polyvinylidene fluoride.

5. A process in accordance with claim 2 wherein the first polymer pair is comprised of an insulating polymethylmethacrylate and a conductive polymethylmethacrylate, and the second polymer pair is comprised of an insulating polytrifluoroethylmethacrylate and a conductive polytrifluoroethylmethacrylate.

6. A process in accordance with claim 4 wherein the conductive polymethylmethacrylate and the conductive polyvinylidene fluoride contain dispersed therein carbon black in an amount of from about 10 to about 40 weight percent.

7. A process in accordance with claim 5 wherein the conductive polymethylmethacrylate and the conductive polytrifluoroethylmethacrylate contain dispersed therein carbon black in an amount of from about 10 to about 40 weight percent.

8. A process in accordance with claim 1 wherein the polymer is rendered conductive with carbon black present in an amount of from about 10 to about 40 weight percent.

9. A process in accordance with claim 1 wherein the polymer is rendered conductive with carbon black present in an amount of from about 20 to about 40 weight percent.

10. A process in accordance with claim 1 wherein said core is steel, or a ferrite.

11. A process in accordance with claim 2 wherein said core is steel, or a ferrite.

12. A process in accordance with claim 1 wherein the first and second polymer pair each contain an insulating polymer with a conductivity of about $10^{-15}$ (ohm-cm)$^{-1}$ and a conductive polymer with a conductivity of about $10^{-2}$ (ohm-cm)$^{-1}$.

13. A process in accordance with claim 1 wherein the first polymer pair contains an insulating polymer with a conductivity of about $10^{-15}$ (ohm-cm)$^{-1}$, and the second polymer pair contains a conductive polymer with a conductivity of about $10^{-2}$ (ohm-cm)$^{-1}$.

14. A process in accordance with claim 1 wherein the first polymer pair is present in an amount of from about 1 to about 99 weight percent, and the second polymer pair is present in an amount of from about 1 to about 99 weight percent.

15. A process in accordance with claim 1 wherein the first polymer pair is present in an amount of from about 40 to about 60 weight percent, and the second polymer pair is present in an amount of from about 60 to about 40 weight percent.

16. A process in accordance with claim 1 wherein heating is accomplished at a temperature of from about 300 to about 550° F.

17. A process in accordance with claim 1 wherein cooling is accomplished by termination of heating.

18. A process in accordance with claim 2 wherein cooling is accomplished to from about 25° F. to about 100° F. by termination of heating.

19. A process in accordance with claim 2 wherein the triboelectric charging value of the resulting carrier particles is from about −40 microcoulombs per gram to about +40 microcoulombs per gram.

20. A process for the preparation of carrier particles with substantially stable conductivity parameters, which comprises (1) mixing carrier cores with a first polymer pair and a second polymer pair and wherein the first and second polymer pair contains an insulating polymer and a conductive polymer; (2) dry mixing the carrier core particles and the polymer mixtures for a sufficient period of time enabling the polymer mixture to adhere to the carrier core particles; (3) heating the mixture of carrier core particles and polymer mixture to a temperature of between about 200° F. and about 550° F., whereby the polymer mixture melts and fuses to the carrier core particles; and (4) thereafter cooling the resulting coated carrier particles.

21. A process in accordance with claim 20 wherein the carrier core is steel, iron and ferrites.

22. A process in accordance with claim 20 wherein the resulting carrier particles are of a conductivity of from about $10^{-6}$ mho-cm$^{-1}$ to about $10^{-15}$ mho-cm$^{-1}$.

23. A process in accordance with claim 20 wherein the triboelectric charging value of the resulting carrier particles is from about −40 microcoulombs per gram to about a positive 40 microcoulombs per gram.

24. A process in accordance with claim 20 wherein the coating is continuous, and is present in a thickness of from about 0.2 micron to about 1.5 microns.

25. A process in accordance with claim 20 wherein the polymer mixture is heated for a period of from about 10 minutes to about 60 minutes.

26. A process in accordance with claim 20 wherein the carrier core particles have an average particle diameter of between about 30 microns and about 200 microns.

27. A process in accordance with claim 20 wherein the carrier core has a surface area of at least 200 cm$^2$ per gram, and up to 1,000 cm$^2$ per gram.

28. A process in accordance with claim 20 wherein the polymer mixture adheres to the carrier core particles by impaction or by electrostatic attraction.

29. A process in accordance with claim 20 wherein the polymers in each pair are dissimilar.

30. A process for the preparation of conductive carrier particles consisting of essentially of mixing a carrier core with a first polymer and a second polymer pair; heating the mixture; and cooling the mixture; and wherein the first polymer is insulating and the second polymer pair contains an insulating polymer and a conductive polymer; and wherein the carrier conductivity thereof is from about $10^{-6}$ to about $10^{-14}$ (ohm-cm)$^{-1}$.

31. A process in accordance with claim 30 wherein the first polymer is polymethylacrylate and the second polymer pair is comprised of polyvinylidene fluoride and polyvinylidene fluoride with a conductive component.

32. A process in accordance with claim 30 wherein the first polymer is polyvinylidene fluoride, and the second polymer pair is comprised of polymethylmethacrylate and polymethylacrylate with a conductive component.

33. A process in accordance with claim 31 wherein the conductive component is carbon black.

34. A process in accordance with claim 32 wherein the conductive component is carbon black.

35. A process in accordance with claim 34 wherein the carbon black is present in an amount of from about 10 to about 40 weight percent.

36. A process in accordance with claim 30 wherein the carrier core is comprised of steel, iron, or ferrites.

37. A process in accordance with claim 30 wherein the triboelectric charging value of the resulting carrier particles is from about −40 microcoulombs per gram to about a positive 40 microcoulombs per gram.

38. A process in accordance with claim 30 wherein the coating is continuous, and is present in a thickness of from about 0.2 micron to about 1.5 microns; and wherein the polymer mixture is heated for a period of about 10 minutes to about 60 minutes.

39. A process in accordance with claim 1 wherein the polymers of each pair are chemically dissimilar.

40. A process in accordance with claim 1 wherein four carrier cores are selected.

41. A process for the preparation of carrier particles consisting essentially of mixing carrier cores with a first polymer pair and a second polymer pair; heating the mixture; and cooling the mixture; and wherein the first and second polymer pair each contain an insulating polymer and a conductive polymer, and wherein said first polymer pair and said second polymer pair are triboelectrically dissimilar.

42. A process for the preparation of conductive carrier particles consisting of mixing carrier core particles with a first polymer pair and a second polymer pair wherein the first polymer pair contains an insulating polymer and a conductive polymer, and the second polymer pair contains an insulating polymer and a conductive polymer, wherein the conductive polymer contains dispersed therein a conductive component, and wherein the conductivity of the resulting carrier particles is from about $10^{-6}$ to about $10^{-4}$(ohm-cm)$^{-1}$.

43. A process in accordance with claim 42 wherein the first polymer pair is comprised of an insulating polymethylmethacrylate and a conductive polymethylmethacrylate, and the second polymer pair is comprised of an insulating polyvinylidene fluoride and a conductive polyvinylidene fluoride.

* * * * *